United States Patent [19]

Benedick

[11] Patent Number: 4,697,531

[45] Date of Patent: Oct. 6, 1987

[54] RETAINING WALL WITH HEAT EXCHANGE CHARACTERISTICS FOR THERMAL REGENERATION

[75] Inventor: Edward H. Benedick, Morristown, N.J.

[73] Assignee: Regenerative Environmental Equip. Co., Inc., Morris Plains, N.J.

[21] Appl. No.: 874,876

[22] Filed: Jun. 16, 1986

Related U.S. Application Data

[63] Continuation of Ser. No. 196,590, Oct. 14, 1980, abandoned.

[51] Int. Cl.[4] ..... F23M 5/00

[52] U.S. Cl. ..... 110/336; 110/338; 110/211; 422/175

[58] Field of Search ..... 110/336, 337, 338, 210–211; 431/170; 422/175

[56] References Cited

U.S. PATENT DOCUMENTS

| | | | |
|---|---|---|---|
| 907,682 | 12/1908 | Cotton | 110/336 X |
| 3,362,698 | 1/1968 | Cerny et al. | 110/336 X |
| 3,895,918 | 7/1975 | Mueller | 110/212 X |

*Primary Examiner*—Edward G. Favors

[57] ABSTRACT

A refractory wall for a combustion chamber comprising a plurality of wall portions which include refractory blocks having generally horizontal, front-to-back passageways interspersed with a plurality of portions which include unperforated refractory blocks. Outwardly of each perforated block portion a heat-exchange section is located with the perforated block portion serving to retain heat-exchange elements in that section and to resist their considerable lateral thrust. At the same time the perforated portions are integrated with the non-perforated portions to form a continuous circular wall of superior strength and resistance to elevated temperatures as well as to chemical attack.

11 Claims, 4 Drawing Figures

RETAINING WALL WITH HEAT EXCHANGE CHARACTERISTICS FOR THERMAL REGENERATION

This application is a continuation of application Ser. No. 196,590, filed Oct. 14, 1980 abandoned.

BACKGROUND OF THE INVENTION

A. Field of the Invention

This invention relates to refractory structures and, in particular, to a perforated inner retaining wall made of refractory block usable in heat exchange apparatus.

B. Prior Art

Recently, with the advent of ever-higher energy cost figures, there has been a correspondingly increased demand for apparatus which can conserve heat thereby reducing fuel costs. One such apparatus which is usable especially in thermal regenerative apparatus for pollution control, for example, is shown in U.S. Pat. No. 3,895,918 issued to James H. Mueller on July 22, 1975. As shown in that patent, there is a central high temperature combustion or incineration chamber surrounded at equi-angularly spaced intervals by a number of contiguous heat-exchange sections. These sections communicate with the combustion chamber and with an external supply of pollutants such as noxious effluents from industrial processes. The effluents are applied by employing automatic dampers to predetermined ones of the heat-exchange sections during any given cycle of operation. In each section, there is a heat-exchange bed made of a number of ceramic heat-exchange elements which are retained outwardly by a perforated steel wall and inwardly (closest to the combustion chamber) by another perforated or louvered metallic wall. Since a great quantity of heat exchange elements are poured into the space between these two retaining walls, there is a great amount of lateral thrust exerted by their combined weight.

When the effluents are passed through a predetermined one or ones of the heat-exchange sections during a processing cycle, their temperature is increased by the residual heat in the ceramic elements of that section gained in a previous cycle when gas purified in the combustion chamber was drawn through that section to exhaust. After being preheated in that section, the incoming effluents enter the combustion chamber where their harmful components are oxidized. The purified effluent is then drawn out of the combustion chamber through others of the heat-exchange sections into the exhaust circuit for dispersion to the ambient atmosphere.

In such heat regenerative structures, the considerable lateral thrust of the ceramic heat exchange elements often required the use of steel tie rods extending horizontally between the front retaining wall ("hot face") and the rear retaining wall ("cold face"). These tie rods, as well, prevented bowing or deflection of the hot face due to heat. At the ends of these rods special washers and nuts were used to adjust the tension of the rods. Special horizontal pins were also lodged in the side edges of the front retaining wall for added structural strength. At incineration temperatures of up to about 1200°-1600° F., the hot face was often made of very expensive material such as high nickel-chromium content steel having low creep. For operation of the combustion chamber at even more elevated temperatures such as in the 1600°-1800° F. region, considerably more of this expensive steel would be required.

Moreover, the front retaining wall in conventional apparatus was often subjected to attack by the corrosive or other chemically destructive effects of some constituents of the effluents resulting in shortened life of such metallic walls. The front retaining walls of metal also had no substantial heat-exchange qualities.

Checker-board refractory walls have been used conventionally to provide heat-exchange properties, but, in general, they are so constructed as to be unable to withstand a considerable load. While U.S. Pat. No. 2,125,193 does show refractory blocks with grooves on one side which are disposed with the grooves of adjacent blocks to form an axial opening for permitting oxygen flor through the openings, there is no teaching of a horizontal arch-like wall consisting of a number of refractory blocks having axial passageways extending through them integrated into a circular combustion chamber wall. Such curved wall serves as an additional heat exchange assembly that can more economically withstand higher combustion temperatures and chemical attack and resist lateral thrust pressures.

It is therefore among the objects of the present invention to provide a refractory wall which:

(1) Is more temperature resistant than conventional walls used in heat-exchange apparatus.

(2) Is less expensive to erect and to maintain than comparable known walls.

(3) Is more resistant to chemical attack than conventional walls.

(4) Is productive of greater heat-exchange effects than conventional metallic retaining walls.

(5) Is capable of imparting greater strength to the overall furnace wall into which it is integrated than conventional metal-concrete constructions.

BRIEF SUMMARY OF THE INVENTION

A combustion chamber wall which has at least one portion comprising a plurality of refractory blocks perforated by a plurality of generally horizontal passageways. The blocks are laid in contiguous fashion in a generally horizontal arch-shaped array in front of a plurality of heat-exchange elements which it helps to retain. In one embodiment, the blocks are interspersed with unperforated bricks to form an integrated circular refractory assembly.

DETAILED DESCRIPTION OF THE DRAWINGS

Figure 1:
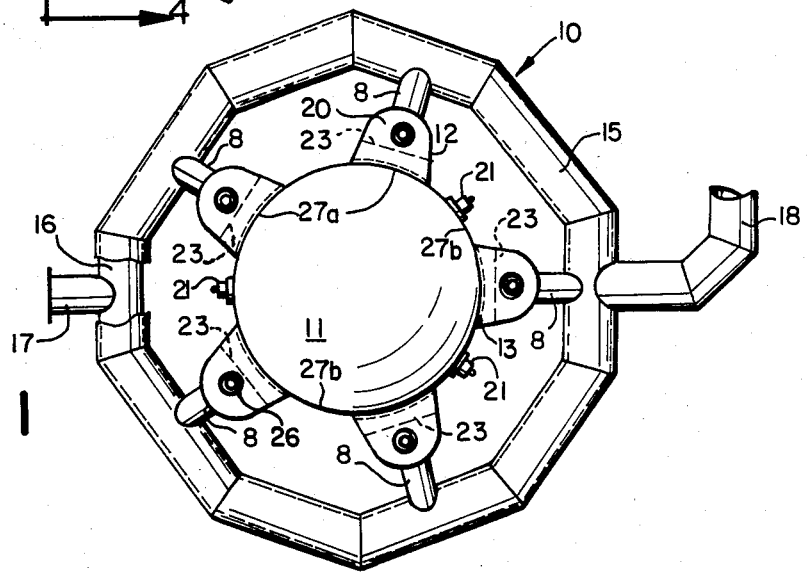
FIG. 1 is a plan view, partly broken away, of thermal regenerative apparatus in which the present invention may be employed.

FIG. 1 shows a thermal regenerative apparatus generally at numeral 10 in accordance with the teachings of the aforesaid Mueller patent. It includes a central, domed combustion chamber 11 with burners 21 projecting therein. Around chamber 11 are disposed, at equal spaces, a plurality of sections 12 each of which includes a perforated outer retaining wall 23 and, inwardly thereof, a heat-exchange bed 13 in which a large number of refractory heat-exchange elements 24 are disposed. Industrial effluents are applied via inlet duct 17 to a generally toroidal inlet ring 16 that is coupled via feeder duct 9 (FIG. 2) to the spaces 20 outwardly of outer retaining wall 23. An inlet valve 14 is disposed in each feeder duct 9 to enable cycle changes. Another duct 26 having a valve 26*a* passes into space 20 through top wall 25 covering each heat exchange section for introducing "purging" gas as mentioned in the cited Mueller patent, if desired. Also attached to each section 12 is an outlet duct 8 having an outlet valve 19 disposed therein. Ducts 8 communicate with spaces 20 and with outlet toroidal ring 15 to which exhaust duct 18 is also coupled. Duct 18 may be connected to an exhaust blower and a stack.

Figure 3:
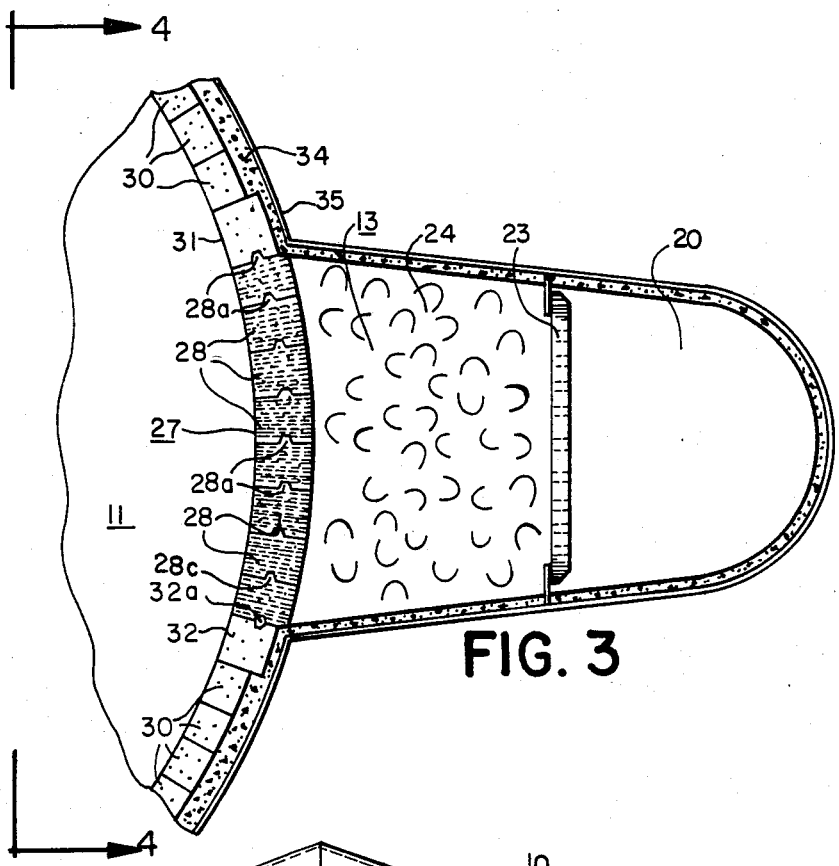
FIG. 3 is a fragmentary, partly sectional plan view of the retaining wall shown in FIG. 2.
Figure 2:
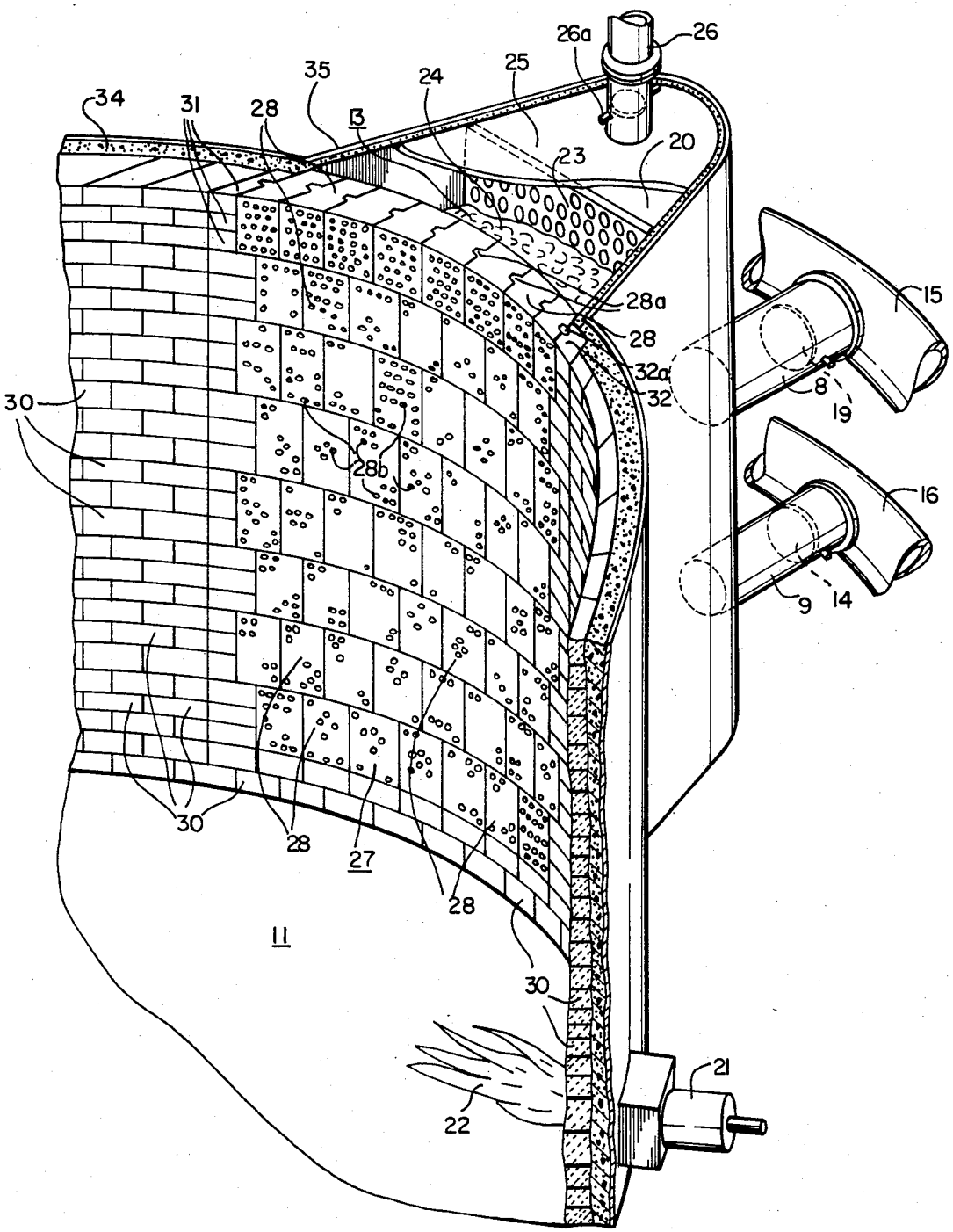
FIG. 2 is a perspective view looking outwardly from the combustion chamber showing the novel perforated-brick retaining wall in accordance with the present invention.

As shown in FIGS. 2 and 3, the refractory elements 24 are retained outwardly by perforated metal plate or wall 23 and toward the center by a curved combustion chamber wall indicated generally at numeral 27 (FIG. 2). Wall 27 comprises a plurality of portions which include perforated refractory bricks 28 laid in curved rows as shown in FIGS. 2 and 3. These curved wall portions 27*a* are interspersed with other curved, circular wall portions, 27*b* consisting of arrays of unperforated bricks 30 to form a continuous curved (cylindrical) lining for the combustion chamber 11.

Behind the unperforated bricks 30, 31, and 32, is an outer wall 34 consisting of, for example, "Monoblock" or other commercially available high temperature insulating material which may be either of the low density or high density type. Surrounding and supporting the refractory bricks 30, 31 and 32 is a metal shell 35 which also surrounds each heat exchange section 12.

Figure 4:
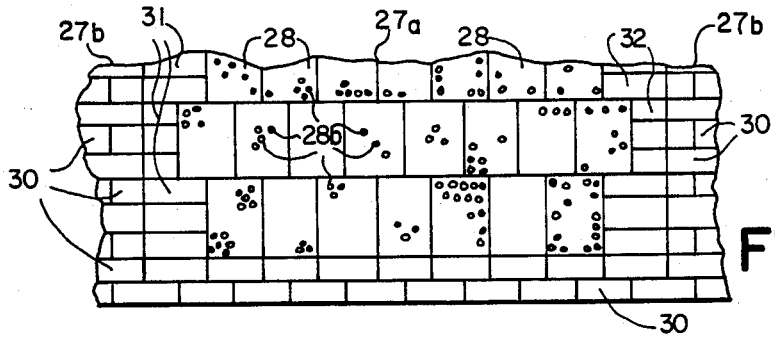
FIG. 4 is a fragmentary side elevation view taken along view line 4—4 in FIG. 3.

As seen best in FIGS. 2, 3 and 4, each of the refractory bricks 28 has a number of axial passageways 28*b* to enable effluents that have been unpurified to enter or leave the combustion chamber 11 for processing or for exhaust, respectively. The particular refractory blocks 28 shown have perforations 28*b* comprising one third of the vertical cross-section of the block. This ratio has been found to enable the thermal efficiency of the overall apparatus in particular installations to be maintained by not introducing an unnecessarily high pressure drop while allowing adequate flow for full purification in the combustion chamber. Of course, each installation may impose its own requirements on the number or size of perforations for the block.

Each block 28 also has, in the embodiment shown, a vertical ridge 28*a* positioned on one side which is designed to mate with the corresonding groove 28*c* formed on the opposite side of the brick adjacent to it. Each block in the embodiment shown in FIGS. 2, 3 and 4 has a horizontal cross-section as shown in FIG. 3 which facilitates the erection of a horizontal, arch-shaped, retaining wall portion 27*a* inwardly of each heat-exchange bed 13 and thus the entire wall structure 27 has a high hoop strength. The blocks 28 extend generally in front of the opening formed by the non-parallel walls of each heat-exchange section 12. Unperforated bricks 31 and 32 as shown in FIG. 2 form the transition between the blocks 28 and bricks 30.

The perforated refractory block retaining wall shown in the drawings has been found to effect considerable cost savings compared to the flat, rigid metallic inner retaining wall of the prior art. Its erection is merely a masonry project not requiring special steels, special washers, special tie rods, special side-pins and other equipment and assembly costs. Its operation also achieves cost savings as it can withstand higher combustion chamber temperatures and their adverse effects without resort to the very expensive special steels which would otherwise be required. Those steel walls are, in any event, more vulnerable to chemical attack than refractory materials and cannot enhance the heat-exchange properties of the apparatus as refractory materials can.

What is claimed is:

1. In a heat-exchange apparatus, the combination comprising:

(a) a central high temperature combustion zone, (b) a vertical wall having a generally closed curve configuration surrounding said zone and made principally of a plurality of refractory, corrosion-resistant blocks, said wall having a first plurality of portions which comprise curved element-holding wall portions in which the blocks are of unitary construction and are disposed in contiguous end-to-end relation in a plurality of rows, with blocks in the rows being in staggard relation to blocks in other rows, to altogether define the curved element-holding wall portion, and in which a substantial plurality of said blocks are perforated therethrough interspersed with a second plurality of portions which are unperforated, said first and second pluralities of portions forming a substantially continuous structures, (c) a plurality of heat-exchange sections disposed outwardly of said wall but in contiguity therewith, each section being located at a corresponding one of said first plurality of portions in which said blocks are perforated, each section including an outer gas-permeable wall member which cooperates with said one perforated portion disposed inwardly thereof to retain a plurality of heat-exchange elements which exert considerable pressure laterally on said one perforated portion and on said outer wall member, said corresponding perforated portion being constructed to have its convex side facing and in contact with said elements and its concave side facing said zone, said perforations being dimensioned to prevent said heat-exchange elements from passing through them under the force of pressurized gas passing through said section, with the perforations in the unitary blocks extending between and connecting opposite said sides of said perforated wall portion between and forming gas conduits between said high temperature combustion zone and a said heat-exchange section, and (d) means coupled to said section for bringing purified or unpurified effluents to or from said section.

2. The combination according to claim 1 wherein said wall is substantially circular and the blocks of said first plurality are laid next to one another in a number of adjacent horizontal rows.

3. The combination according to claim 1 wherein the perforations of the blocks of said first plurality are a plurality of passageways extending from the front to the back of each such block.

4. The combination according to claim 3 wherein said passageways of each block constitute about 30–40% of the volume thereof and are substantially horizontal.

5. The combination according to claim 1 wherein each block of said first plurality has a ridge on one side and a groove on the other whereby adjacent ones of said blocks can mate with one another.

6. The combination according to claim 1 wherein said circular wall has substantially uniform thickness but the thickness of the wall at said first plurality of portions is made up solely by the front-to back dimensions of a single brick whereas the thickness of the wall at said second plurality of portions is made up of at least two horizontally displaced but abutting vertical sets of refractory bricks.

7. The combination according to claim 1 wherein the outer side of said wall portions and said heat exchange sections are sheathed in metal.

8. In heat-exchange apparatus having a generally centrally disposed high temperature combustion zone surrounded by an enclosure having spaced portions made of gas impermeable refractory material, the combination comprising:

(c) a plurality of heat-exchange sections disposed outwardly of but contiguity with said enclosure at the spaces thereof between said said gas-impermeable portions, each section including an inner retaining wall and a gas-permeable outer retaining wall for holding a plurality of discrete heat-exchange elements piled on one another which exert considerable lateral pressure on said inner and outer walls, each of said inner retaining walls comprising a plurality of adjacent perforated corrosion-resistant refractory blocks which comprise curved element-holding wall portions disposed generally closed curve configuration, wherein the blocks are of unitary construction and are disposed in contiguous end-to-end relation in a plurality of rows, with blocks in the rows being in staggard relation to blocks in other rows, to altogether define the curved element-holding wall portion, whose concave side faces said zone and whose convex side faces and contacts said elements, the perforations in said blocks extending between and connecting opposite said sides of said curved element-holding wall portions between and forming gas conduits between said high temperature combustion zone and a said heat-exchange section, and being dimensioned to prevent said elements from passing through them under the force of pressurized gas passing through said section, and (d) means coupled to said sections for bringing purified or unpurified effluents to or from said sections.

9. In heat exchange apparatus according to claim 8, wherein said refractory blocks have mating, substantially vertical portions which coopertes in resisting the lateral thrust exerted thereupon by said heat-exchange elements.

10. The combination according to claim 1, and with the said perforations of said blocks located substantially within said borders of the blocks in non-traversing relation with said borders.

11. The combination according to claim 8, with the said perforations of said blocks located substantially within said borders of the blocks in non-traversing relation with said borders.

* * * * *

UNITED STATES PATENT OFFICE

CERTIFICATE OF CORRECTION

Patent No. 4,697,531 Dated October 6, 1987

Inventor(s) Edward H. Benedick

It is certified that error appears in the above-identified patent and that said Letters Patent are hereby corrected as shown below:

Column 2, line 15, change "flor" to --flow--.

In the Claims

Column 5, line 21, claim 8, change "(c)" to --(a)--.

Column 5, line 22, claim 8, change "contiguity" to --contiguous--.

Column 5, line 23, claim 8, delete "said", second occurrence.

Column 6, line 17, claim 8, change "(d)" to --(b)--.

Column 6, line 21, claim 9, change "coopertes" to --cooperates--.

Signed and Sealed this

Thirty-first Day of May, 1988

*Attest:*

*Attesting Officer*

DONALD J. QUIGG

*Commissioner of Patents and Trademarks*